United States Patent [19]

Sakamoto

[11] Patent Number: 4,764,176

[45] Date of Patent: Aug. 16, 1988

[54] METHOD FOR PREVENTING THE BRIGHTENING EFFECT OF OPTICAL BRIGHTENING AGENTS ON TEXTILES

[75] Inventor: Toshinobu Sakamoto, Osaka, Japan

[73] Assignee: Sandoz Ltd., Basle, Switzerland

[21] Appl. No.: 886,131

[22] Filed: Jul. 16, 1986

[30] Foreign Application Priority Data

Jul. 22, 1985 [GB] United Kingdom ..... 8518489

[51] Int. Cl.[4] ..... D06L 3/12; D06M 13/36; D06M 15/42

[52] U.S. Cl. ..... 8/442; 8/495; 8/496; 8/554; 8/566; 8/567; 8/568; 8/606; 8/648; 8/918; 8/532; 548/350; 162/158

[58] Field of Search ..... 8/648, 496, 442

[56] References Cited

U.S. PATENT DOCUMENTS

| | | | |
|---|---|---|---|
| 2,649,354 | 8/1953 | Hemmi | 8/551 |
| 3,141,728 | 7/1964 | Bockmann et al. | 8/551 |
| 3,542,642 | 11/1970 | Speese et al. | 162/158 |
| 3,639,642 | 2/1972 | Matter et al. | 548/350 |
| 4,098,954 | 7/1978 | Raspanti | 162/158 |
| 4,210,763 | 7/1980 | Raspanti | 548/350 |
| 4,410,652 | 10/1983 | Robinson et al. | 524/195 |
| 4,439,203 | 3/1984 | Runyon et al. | 8/496 |
| 4,443,223 | 4/1984 | Kissling et al. | 8/496 |
| 4,452,606 | 6/1984 | van Diest et al. | 8/496 |
| 4,475,918 | 10/1984 | Kissling et al. | 8/495 |
| 4,511,707 | 4/1985 | Runyon et al. | 8/496 |
| 4,695,405 | 9/1987 | Harnisch et al. | 8/102 |

FOREIGN PATENT DOCUMENTS

| | | |
|---|---|---|
| 898298 | 6/1962 | United Kingdom . |
| 952680 | 3/1964 | United Kingdom . |

*Primary Examiner*—A. Lionel Clingman

*Attorney, Agent, or Firm*—Gerald D. Sharkin; Richard E. Vila; Thomas C. Doyle

[57] ABSTRACT

The invention relates to a method for preventing the brightening effect of an optical brightening agent on a textile substrate comprising applying on the textile substrate a water-soluble, cationic, optical brightener quencher either before or together with a resin precursor and submitting the treated substrate to a heat treatment. This method imparts an antibrightening effect to goods when they are washed with an optical brightener containing detergent.

27 Claims, No Drawings

METHOD FOR PREVENTING THE BRIGHTENING EFFECT OF OPTICAL BRIGHTENING AGENTS ON TEXTILES

The present invention relates to a method for preventing the brightening effect of optical brightening agents on off-white casual or pastel shade goods.

Nowadays optical brighteners are frequently incorporated in domestic detergents. When off-white goods and pastel shade dyed goods which are in fashion are washed with such a domestic detergent, they are unpleasantly stained by the optical brightener and pastel shade dyed goods additionally look like unlevel dyeings.

It has now been found a method for preventing this undesirable staining effect of optical brighteners from occurring.

Accordingly, there is provided a method for preventing the brightening effect of an optical brightening agent on a textile substrate comprising applying on the textile substrate a water-soluble, cationic optical brightener quencher and a resin precursor either simultaneously or in the sequence of quencher followed by precursor and submitting the treated substrate to a heat treatment.

By "optical brightener quencher" is meant an agent which nullifies the brightening effect of an optical brightener when they come into contact. Such agents are commonly used in the paper industry, e.g. to produce non-brightened paper from waste paper containing an optical brightener.

Suitable quenchers include acid addition salts or quaternisation products of a cyclic amidine of the formula I

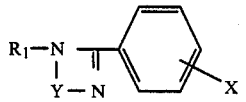

I wherein

Y is a linear or branched $C_{2-4}$ alkylene $R_1$ is hydrogen or an alkyl, aryl or aralkyl group containing up to 7 carbon atoms, X is hydrogen or a radical of the formula

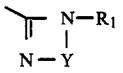

of a polycondensation product containing a plurality of units corresponding to formula Ia

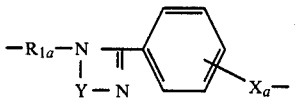

Ia wherein $R_{1a}$ is alkylene containing up to 8 carbon atoms and $X_a$ is

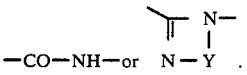

Preferred quenchers for use in the method of the invention are the acid addition salts of or quaternization products of polycondensation products composed of recurring units of formula

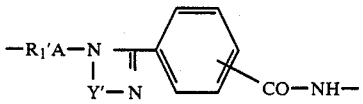

or

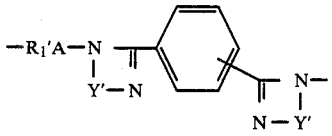

wherein Y' and $R'_{1a}$ are ethylene, 1,2-propylene or 1,3-propylene, among which the following recurring units are particularly preferred:

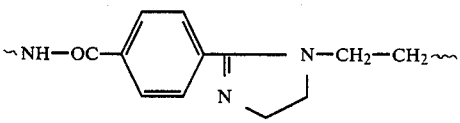

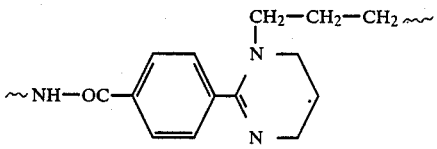

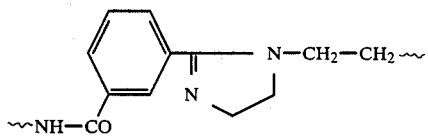

and

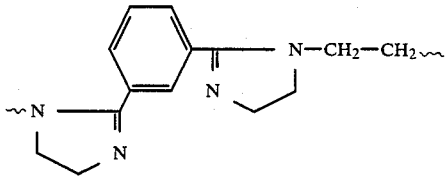

The compounds of formula I and their corresponding polymers are known and are disclosed e.g. in U.S. Pat. Nos. 3,639,642 and 4,210,763 the teachings of which are incorporated herein by reference. Suitable acids for the preparation of the addition salts include inorganic acids, for example hydrochloric, hydrobromic acid, or sulphuric acid, and organic acids, for example an aliphatic or aromatic mono- or polycarboxylic acid, for example formic acid, acetic acid, propionic acid, lactic acid, oxalic acid, adipic acid, tartaric acid, citric acid, gluconic acid, benzoic acid or a nuclear substitution derivative thereof, or an aliphatic or aromatic sulphonic acid, for example methane- or ethanesulphonic acid, benzene-, methylbenzene- or naphthalenesulphonic acid, or an alkylsulphuric acid; preferred acids are acetic acid, benzenesulphonic acid, 4-methylbenzenesulphonic acid, sulphuric acid or hydrochloric acid.

Suitable quaternisation agents for the preparation of the quaternisation products include alkyl, cycloalkyl or aralkyl halides, sulphuric acid mono- or diesters, alkane, benzene or toluene sulphonic acid esters and epoxides, for example butyl bromide, dodecyl bromide, fatty alkyl bromides, ethyl iodide, octadecyl chloride, benzyl chloride, chloro-acetamide, dimethyl sulphate, diethyl sulphate, sodium butyl sulphate, or benzene-sulphonic acid or toluenesulphonic acid methyl or ethyl ester.

The compounds of formula I and their corresponding polymers are protonated or quaternized to the extent that at least one of the protonatable or quaternizable nitrogen atoms present in the molecule is protonated or quaternized, respectively. Preferably all the protonatable or quaternizable nitrogen atoms are on average substantially protonated or quaternized, respectively.

Suitable textile substrates for treatment by the method of the invention include those containing natural, synthetic or semi-synthetic fibres or mixtures thereof, particularly those containing natural, regenerated or modified cellulosic fibres, e.g. cotton, mixtures thereof or mixtures with further synthetic fibres, e.g. polyester. The material may be in any conventional form, for example as yarn, hanks, woven or knitted goods.

The substrate to be treated according to the invention may be in dyed or undyed form, e.g. bleached, mercerised etc. when it contains cotton.

The application of the quencher either alone or together with the resin precursor is carried out according to known methods, preferably by impregnation such as padding, dipping, spray or foam techniques or coating. The temperature of application is such as is compatible with the substrate and chemicals used, preferably at room temperature. The pH conditions are not critical for the application. However, when the resin precursor is applied simultaneously, it is preferably effected at an acidic pH, particularly at pH 3–6. According to an embodiment of the invention the compound of formula I or the corresponding polymer is applied in the free base form and then converted into the salt form by subsequent treatment with an acid on the substrate, either in the absence or in the presence of a resin precursor (when such is compatible with an acid).

As already mentioned, the quencher may be applied before or simultaneously with a resin precursor. The resin precursor may be applied together with a catalyst, e.g. an inorganic or organic catalyst, and is applied on the substrate from an aqueous medium to impart a resin finish. The expression "resin precursor" includes a catalyst when the presence of such is required to obtain the desired resin finish. Suitable resin finishes for the method of the invention are those which on reaction with a catalyst give a finish having a non-ionic or basic character, particularly those used for the finishing of a textile cellulosic substrate. Such finishes are known and disclosed e.g. by Dr. M. W. Ranney in "Crease-Proofing Textiles" (Textile Processing Review, No. 2, NDC, 1970), by Chwala and Anger in "Handbuch der Textilhilfsmittel" (Verlag Chemie, Weinheim, New York, 1977, pages 446 to 466), in U.S. Pat. Nos. 4,475,918, 4,439,203, 4,511,707, 4,452,606 and 4,443,223 or in PCT-application No. 81/02423. Preferred resin finishes are those obtained from a resin precursor such as methylol urea, bis-(methoxymethyl)-urea, poly(methylol)-melamine, 1,3-bis(hydroxymethyl)-imidazolin-2-one optionally in admixture with poly(methylol)-melamine, 5-substituted-1,3-dimethylol-1,3,5-triaz-2-one, bis-(methoxymethyl)-urone, di-methylolpolypropylene urea, a cyclic 1,3-dimethylol-4,5-dihydroxyethylene urea and derivatives, methylolcarbamates and reaction products of a polyalkylene polyamine, especially triethylenetriamine, with dicyanodiamide in the presence of a catalyst such as $MgCl_2$ and optionally with N-methylolalkylene urea, optionally substituted by hydroxy, particularly N,N'-dimethylol ethylene urea, N,N'-dimethylolpropylene urea or N,N'-dimethylol-dihydroxyethylene urea. The resin precursor and the corresponding optional catalyst may be used in an amount lying within the usual range, e.g. from 10 to 100 g/l of resin precursor and from 1 to 10 g/l catalyst.

The quencher when applied by impregnation is advantageously used in an amount of from 1 to 25 g/l, preferably from 3 to 15 g/l. The quencher may be used in the form of an aqueous solution, optionally together with a solubilising agent, e.g. a glycol and/or an alkyl monoether of a glycol such as a $C_{2-8}$ glycol or a $C_{1-4}$alkyl monoether thereof.

After the impregnation, the substrate is submitted to a heat treatment, e.g. a drying step for example at a temperature of from 80° to 140° C., and/or to a heat treatment carried out at a temperature corresponding to the curing temperature of the resin precursor, e.g. at a temperature of from 160° to 190° C. When a cellulosic substrate is treated according to the invention, the impregnated substrate can be first pre-dried for a short time, e.g. at a temperature of from 120° to 140° C. and then cured at a temperature of from 130° to 190° C.

The method of the invention is preferably carried out as the last finishing step before the mechanical working up of the substrate. It is particularly intended for the treatment of goods dyed in a pale shade or off-white goods, preferably cotton goods.

As optical brighteners of which the effect is to be nullified, there may be mentioned the anionic optical brighteners, especially those which contain at least one water-solubilising group, e.g. sulphonic acid radical, for example the anionic optical brighteners of the stilbene series.

According to a preferred embodiment of the invention, cotton goods dyed in a pale shade or off-white cotton goods are impregnated with an aqueous liquor containing a cationic quencher and a resin precursor (and optionally a catalyst) such as disclosed above, and then heat treated in two steps (pre-drying and curing) in order to prevent the optical brightening effects due to an anionic optical brightener.

The method of the invention imparts a permanent antibrightening effect to the substrate. The quencher does not impair the properties of the resin finish applied to the textile substrate.

The following Example, in which all percentages are by weight and the temperature in degrees Centigrade, illustrates the invention.

EXAMPLE

A caustic soda-treated, bleached cotton tricot is padded at room temperature to a pick-up of 80–100% based on its dry weight, with an aqueous bath containing 15 g/l of a commercially available quencher (based on a 50% aqueous solution of a polycondensation product of terephthalic acid dimethyl ester with triethylenetetraamine, quaternised with dimethyl sulphate, MW approx. 9,000–15,000)

60 g/l of a commercially available resin precursor based on a 50% N,N'-dimethylol-dihydroxy-ethylene urea solution (e.g. Sumitex Resin NS-16, Registered Trade Mark) and 5 g/l of a magnesium salt catalyst (25% active substance) e.g. Sumitex Accelerator MX, Registered Trade Mark.

The impregnated substrate is then pre-dried at a temperature from 100°–120° for 60 to 120 seconds and immediately after cured at a temperature from 130° to 190° for 30–180 seconds.

The resulting substrate is then washed at 60° with a commercially detergent containing an optical brightener. After rinsing and drying, the cotton tricot is free from any brightening effect. This antibrightening effect is durable enough even after 30 times domestic washing.

I claim:

1. A method for preventing the brightening effect of a subsequently applied anionic optical brightening agent on a textile substrate which comprises cellulosic fibers, said method comprising applying on such a textile substrate a water-soluble, cationic, optical brightener quencher and a resin precursor useful for the finishing of a cellulosic textile substrate, either simultaneously or in the sequence of quencher followed by precursor, and submitting the treated substrate to a heat treatment.

2. A method according to claim 1, in which the quencher is an acid addition salt or a quaternisation product of a cyclic amidine of the formula I

I

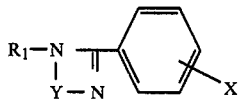

wherein

Y is a linear or branched $C_{2-4}$ alkylene $R_1$ is hydrogen or an alkyl, aryl or aralkyl group containing up to 7 carbon atoms, X is hydrogen or a radical of the formula

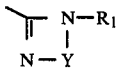

of a polycondensation product containing a plurality of units corresponding to formula Ia Ia

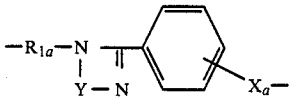

wherein $R_{1a}$ is alkylene containing up to 8 carbon atoms and $X_a$ is

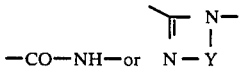

3. A method according to claim 1, in which the quencher is an acid addition salt of or a quaternization product of polycondensation product composed of recurring units of formula

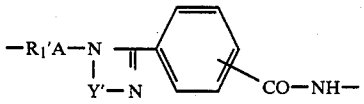

or

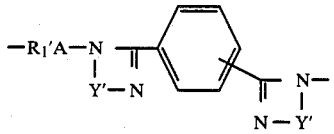

wherein

Y' and $R'_{1a}$ are ethylene, 1,2-propylene or 1,3-propylene.

4. A method according to claim 1, in which the quencher is an acid addition salt of or a quaternization product of polycondensation product composed of recurring units of formulae

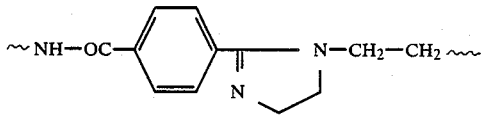

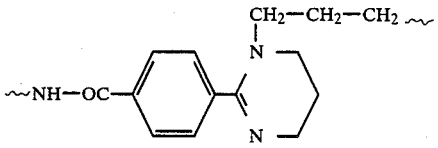

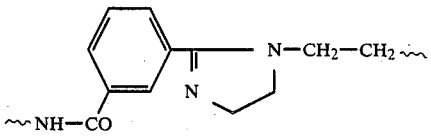

or

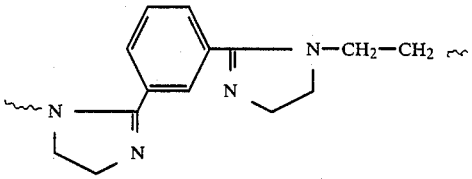

5. A method according to claim 1, in which the resin precursor is a product which imparts to the textile a resin finish having a non-ionic or basic character.

6. A method according to claim 1, in which the cationic quencher is applied on the substrate by impregnation.

7. A method according to claim 1, in which the quencher is applied an aqueous solution in an amount from 1 to 25 g/l.

8. A method according to claim 1, in which the resin precursor is applied from an aqueous medium in an amount from 10 to 100 g/l.

9. A method according to claim 6, in which the impregnated textile substrate is pre-dried at a temperature of from 80° to 140° C. and then cured at a temperature of from 160° to 190° C.

10. A method according to claim 1, in which the textile substrate is either in dyed or undyed state.

11. A method according to claim 1, in which the resin precursor is selected from methylol urea, bis-(methoxymethyl)-urea, poly(methylol)-melamine, 1,3-bis(hydroxymethyl)-imidazolin-2-one, mixtures of 1,3-bis(hydroxymethyl)-imidazolin-2-one with poly(methylol)-melamine, 5-substituted 1,3-dimethylol-1,3,5-triaz-2-one, bis(methoxymethyl)-urone, dimethylolpolypropylene urea, a cyclic 1,3-dimethylol-4,5-dihydroxyethylene urea and derivatives, methylolcarbamates, reaction products of a polyalkylene polyamine with dicyanodiamide in the presence of a catalyst and reaction products of a polyalkylene polyamine with dicyanodiamide in the presence of a catalyst and an N-methylol alkylene urea or a hydroxy-substituted N-methylol alkylene urea.

12. A method according to claim 1 in which cotton goods dyed in a pale shade or off-white cotton goods are impregnated with an aqueous liquor containing the optical brightener quencher and the resin precursor and then heat-treated in two steps to first dry the treated goods and then cure the resin precursor.

13. A method according to claim 1 which comprises the further step of applying to the treated substrate an anionic optical brightening agent, whereby no optical brightening effect is obtained.

14. A method according to claim 2 in which the cationic quencher is applied on the substrate by impregnation and the resin precursor is a product which imparts to the textile a resin finish having a non-ionic or basic character.

15. A method according to claim 2 in which all of the protonatable or quaternizable nitrogen atoms of the quencher compound are, on average, substantially protonated or quaternized respectively.

16. A method according to claim 2 in which the resin precursor is selected from methylol urea, bis-(methoxymethyl)-urea, poly(methylol)-melamine, 1,3-bis(hydroxymethyl)-imidazolin-2-one, mixtures of 1,3-bis(hydroxymethyl)-imidazolin-2-one with poly(methylol)-melamine, 5-substituted 1,3-dimethylol-1,3,5-triaz-2-one, bis(methoxymethyl)-urone, dimethylolpolypropylene urea, a cyclic 1,3-dimethylol-4,5-dihydroxyethylene urea and derivatives, methylolcarbamates, reaction products of a polyalkylene polyamine with dicyanodiamide in the presence of a catalyst and reaction products of a polyalkylene polyamine with dicyanodiamide in the presence of a catalyst and an N-methylol alkylene urea or a hydroxy-substituted N-methylol alkylene urea.

17. A method according to claim 12 in which the quencher is applied in an amount from 1 to 25 g/l, the resin precursor is applied in an amount from 10 to 100 g/l and the treated cotton goods are pre-dried at a temperature of 120° to 140° C. and then cured at a temperature of 130° to 190° C.

18. A method according to claim 12 which comprises the further step of applying to the treated cotton goods an anionic optical brightener, whereby no optical brightening effect is obtained.

19. A method according to claim 12 in which the application of the quencher and resin precursor is effected at a pH of 3 to 6.

20. A method according to claim 13 in which the optical brightening agent contains at least one sulphonic acid radical.

21. A method according to claim 16 in which the quencher is applied in an amount from 1 to 25 g/l, the resin precursor is applied in an amount from 10 to 100 g/l and the treated textile substrate is pre-dried at a temperature of 80° to 140° C. and then cured at a temperature of 160° to 190° C.

22. A method according to claim 16 which comprises the further step of applying to the treated substrate an anionic optical brightening agent, whereby no optical brightening effect is obtained.

23. A method according to claim 21 which comprises the further step of applying to the treated substrate an anionic optical brightening agent, whereby no optical brightening effect is obtained.

24. A method according to claim 22 in which the optical brightening agent contains at least one sulphonic acid radical.

25. A method according to claim 23 in which the optical brightening agent contains at least one sulphonic acid radical.

26. A method according to claim 3 in which cotton goods dyed in a pale shade or off-white cotton goods are impregnated with an aqueous liquor containing the optical brightener quencher in an amount of from 1 to 25 g/l and a resin precursor which imparts to the textile substrate a resin finish having a non-ionic or basic character in an amount of from 10 to 100 g/l and the impregnated substrate is subjected to heat treatments at temperatures effective to dry the substrate and cure the resin precursor.

27. A method according to claim 26 which comprises the further step of applying to the treated cotton goods an anionic optical brightener containing at least one sulphonic acid radical, whereby no optical brightening effect is obtained.

* * * * *